US005323553A

United States Patent [19]

Candido

[11] Patent Number: 5,323,553

[45] Date of Patent: Jun. 28, 1994

[54] ALBUM SLEEVE FOR BASEBALL CARDS

[75] Inventor: Thomas A. Candido, Hauppauge, N.Y.

[73] Assignee: Enbee Plastics, Inc., Long Island City, N.Y.

[21] Appl. No.: 11,719

[22] Filed: Jan. 1, 1993

[51] Int. Cl.[5] ..... G09F 19/00

[52] U.S. Cl. ..... 40/537; 40/661

[58] Field of Search ..... 40/537, 405, 159, 661; 206/45.33, 449; 150/147, 149; 383/9, 84, 106

[56] References Cited

U.S. PATENT DOCUMENTS

| | | | |
|---|---|---|---|
| 804,747 | 11/1905 | Mackenzie | 383/106 |
| 1,991,161 | 2/1935 | Kretchmer | 40/537 |
| 2,637,325 | 5/1953 | McCabe | 40/537 |
| 3,097,788 | 7/1963 | Nichols | 206/45.33 X |
| 3,104,798 | 9/1963 | Stone | 383/84 X |
| 3,797,152 | 3/1974 | Brandt | 40/159 X |
| 3,869,820 | 3/1975 | Holson | 40/537 X |
| 4,925,720 | 5/1990 | Hansen | 40/661 X |
| 4,972,952 | 11/1990 | Reiseneder | 40/405 X |
| 5,159,964 | 11/1992 | Baker | 150/147 |
| 5,201,525 | 4/1993 | Castro | 40/159 X |

*Primary Examiner*—Kenneth J. Dorner
*Assistant Examiner*—Joanne Silbermann
*Attorney, Agent, or Firm*—Michael Ebert

[57] ABSTRACT

An album sleeve for storing and displaying at least one baseball card. The sleeve is created from a rectangular blank of transparent plastic film having three transverse fold lines whose parallel positions are such that when the blank is folded on the first line, it then defines a front panel overlying a rear panel. The second fold line is adjacent the end of the front panel to define a broad flap section which is folded over the back of the rear panel to complete the sleeve. The third fold line is adjacent the end of the rear panel to define a narrow flap section that is folded down to form an expandable internal pocket, the pocket being spaced from the second fold line to define a sleeve border that is hole punched so that the sleeve may be retained in a loose-leaf ring binder. The sleeve dimensions are such as to snugly accommodate a baseball card whose edge is received in the pocket and whose lower edge is at the fold between the front and rear panels, whereby the card is prevented from falling out of the sleeve.

9 Claims, 3 Drawing Sheets

Fig. 1.
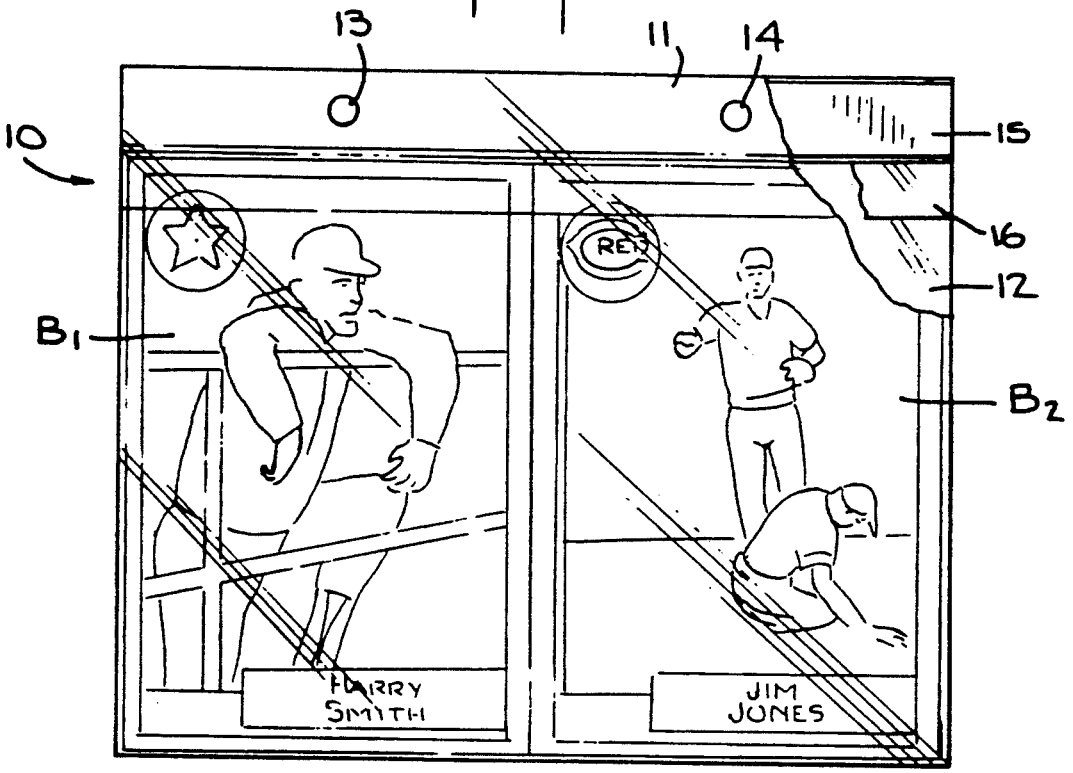
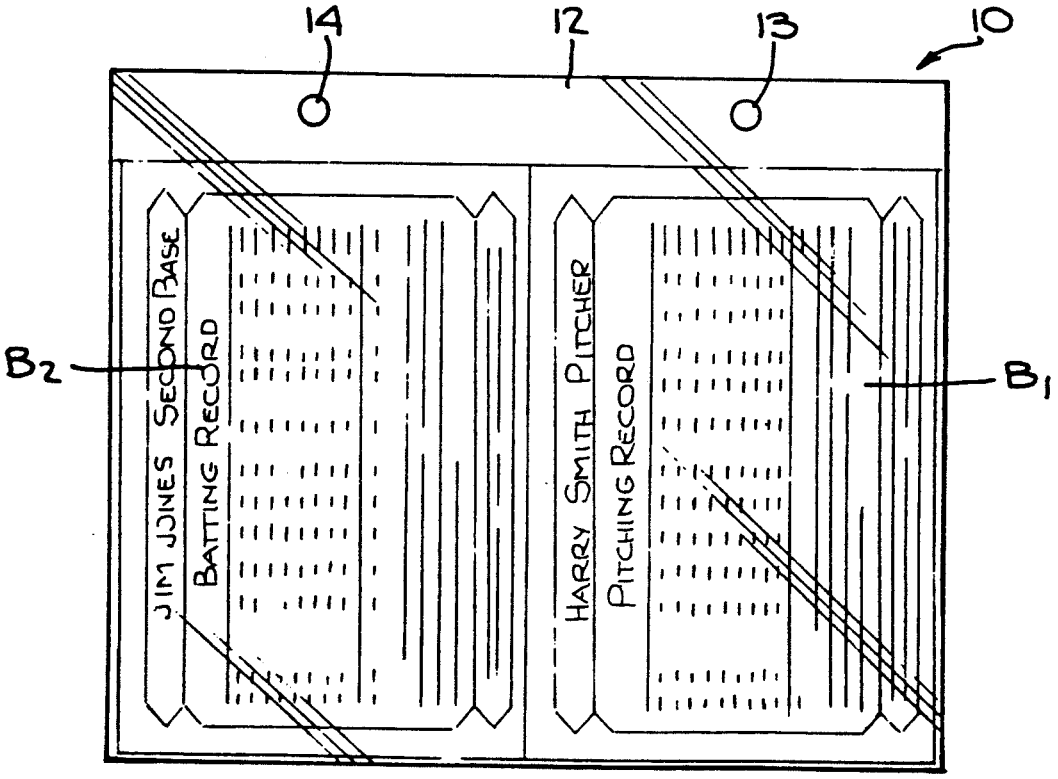
Fig. 2.

ALBUM SLEEVE FOR BASEBALL CARDS

BACKGROUND OF INVENTION

1. Field of Invention

This invention relates generally to jackets or sleeves formed of transparent plastic film material, and more particularly to an album sleeve of this type adapted to snugly retain a baseball card or other media so that it does not fall out of the sleeve when the sleeve is manipulated.

2. Status of Prior Art

It is known to provide jackets or sleeves of transparent plastic film material for mounting photos. Thus, the Dorman U.S. Pat. Nos. 4,452,666 and 4,471,545 disclose a multi-channel jacket formed by superposed panels of transparent Mylar polyester film joined together by parallel ribs of adhesive material, thereby creating open-ended channels for receiving strips of microfilm.

The Shaine U.S. Pat. No. 4,702,026 discloses an album page for storing and displaying a photo, the page being formed of front and rear panels of clear polypropylene film bonded together by lines of adhesive.

The Hickman U.S. Pat. No. 4,810,544 discloses a transparent sleeve for protecting printed media. The sleeve is formed by a sheet of transparent film with a single fold dividing the sheet into two halves. A strip of double-faced adhesive tape runs the length of an edge of the sheet parallel to the fold, thereby holding the halves together to form a sleeve to receive the printed media.

The concern of the present invention is with the protective storage and display of baseball cards. A typical baseball card has printed on one side a picture of a well-known professional baseball player, the player being identified. Printed on the reverse side is data relating to this player, such as his batting record and biographical information.

Baseball is America's national game, and baseball cards have been popular and in circulation for at least 50 years. There are many adults as well as children and adolescents who are avid collectors of such cards. There is also a lively market for baseball cards, for the typical collector takes pride in the scope and quality of his collection and seeks to expand it by new acquisitions. The value of a baseball card depends both on its rarity and condition. Thus, a rare Jackie Robinson or Lou Gehrig baseball card in mint condition commands a higher price at an auction than one which is frayed, creased and soiled.

It is for this reason that many baseball card collectors, rather than putting their cards loosely in storage boxes, place them in protective transparent display jackets or album sleeves, not only to maintain them in good condition, but also so that both sides of each card may be viewed by turning the pages of the album. One commercially available open-ended album sleeve for this purpose takes the form of a rectangular blank of transparent plastic film material which is folded to define front and rear panels, the end of the front panel having a flap section that is folded behind the rear panel and bonded thereto to complete the sleeve. The dimensions of the sleeve are such that it will accommodate baseball cards which are end-loaded into the sleeve.

A pair of holes is punched in the upper margin of the sleeve so that the sleeve can be placed in a loose-leaf ring binder, the cards being received in the sleeve so that their upper edges are below the holes. The advantage of this transparent sleeve is that it displays both the front and rear sides of the baseball cards, and one does not, therefore, have to remove a card from the sleeve in order to read the data printed on the rear side.

The disadvantage of this prior sleeve is that it is oversized with respect to the dimensions of the two rectangular baseball cards contained therein, for the sleeve dimensions must be such as to allow for an upper border for the punch holes. Hence the cards are somewhat loosely held in the sleeve, and when the sleeve is manipulated as in turning the pages of a loose-leaf ring album in which the sleeves form the pages, the cards may then slip out of the open ends of the sleeve, and, as a result, possibly become damaged or soiled.

SUMMARY OF INVENTION

In view of the foregoing, the main object of this invention is to provide an sleeve for protectively storing and displaying a pair of baseball cards in side-by-side relation, the cards being snugly held in the sleeve so that they will not fall out of the open ends when the sleeve is manipulated by a user of a multi-page album, the pages of which are the sleeves.

More specifically, an object of this invention is to provide an album sleeve fabricated of transparent, synthetic plastic film which incorporates an expandable internal pocket adapted to receive the upper edge of a baseball card inserted in the sleeve, the pocket serving to retain the card in the sleeve to prevent it from falling out.

A significant feature of a sleeve in accordance with the invention is that it may be fabricated from a single rectangular blank of transparent film material of high clarity and strength having archival quality, so that the sleeve has a long effective life.

Also an object of the invention is to provide an album sleeve of the above type which may be mass-produced.

Briefly stated, these objects are attained in an album sleeve for storing and displaying at least one baseball card. The sleeve is created from a rectangular blank of transparent plastic film having three transverse fold lines whose parallel positions are such that when the blank is folded on the first line, it then defines a front panel overlying a rear panel. The second fold line is adjacent the end of the front panel to define a broad flap section which is folded over the back of the rear panel to complete the sleeve. The third fold line is adjacent the end of the rear panel to define a narrow flap section that is folded down to form an expandable internal pocket, the pocket being spaced from the second fold line to define a sleeve border that is hole punched so that the sleeve may be retained in a loose-leaf ring binder.

The sleeve dimensions are such as to snugly accommodate a baseball card whose upper edge is received in the internal pocket and whose lower edge is at the fold between the front and rear panels, whereby the card is prevented from falling out of the sleeve.

BRIEF DESCRIPTION OF DRAWINGS

For a better understanding of the invention as well as other objects and further features thereof, reference is made to the following detailed description to be read in conjunction with the accompanying drawings, wherein:

FIG. 1 front view of an open-ended album sleeve in accordance with the invention, which is loaded with a pair of baseball cards, the top panel of which is cut away at the upper right corner to expose the border strip and the expandable pocket in which is received the upper edge of a baseball card, the lower edge being received in the fold between the front and rear panels;

FIG. 2 is a rear view of the loaded sleeve;

DESCRIPTION OF INVENTION

Figure 3:
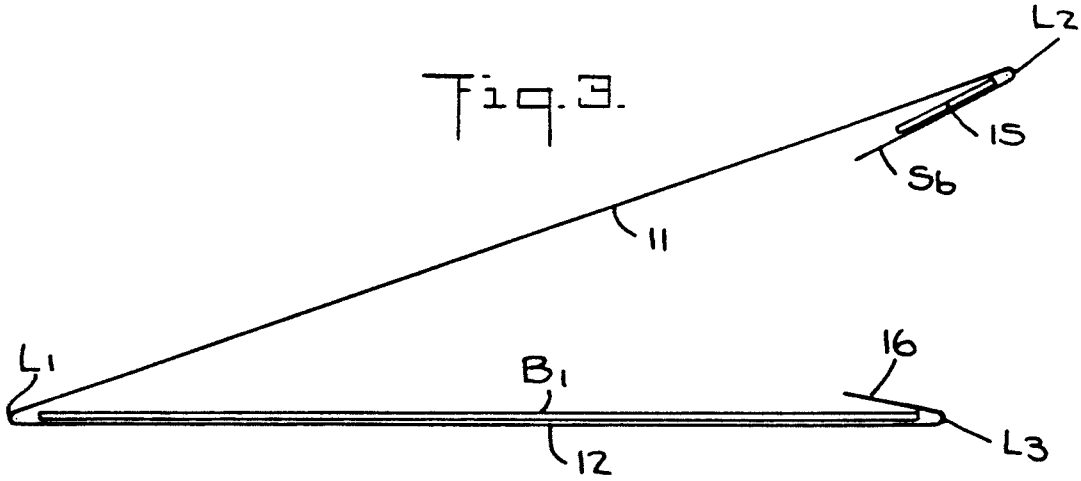
FIG. 3 schematically illustrates the sleeve in an end view with the front and rear panels of the sleeve unfolded.
Figure 4:
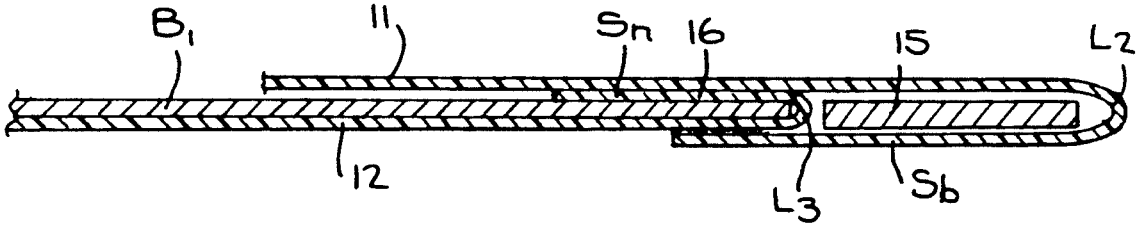
FIG. 4 shows the relationship between the upper edge of the baseball card and the pocket in which it is received.

A standard baseball card is formed of a rectangular card whose dimensions are 2½ by 3½ inches. Printed on the front side of the card is a picture of a baseball player giving his name and team affiliation. Printed on the reverse side is data relating to the player's background and his performance record, such as his major league, batting record and biographical information.

In an open-ended transparent sleeve in accordance with the invention as shown in FIGS. 1 and 2, the sleeve, generally designated by numeral 10, is loaded with two baseball cards $B_1$ and $B_2$ in side-by-side relation. The picture side of the cards is seen through the front panel 11 of the sleeve, and the data printed on the reverse side of the cards is seen through rear panel 12.

Punched in the upper margin of the album sleeve are two punch holes 13 and 14, so that the sleeve may be held as a page in a loose-leaf ring binder and the user of the album by turning the pages can view both side of the cards displayed and stored in the album without having to remove the cards from the sleeves.

The sleeve dimensions are 5 by 4 inches to allow for an inch border above the 2½×3½ inch cards housed in side-by-side relation in the sleeve. The border is reinforced and and stiffened by a paper strip 15 housed within the sleeve. The rear panel 12 is provided with a folded-down section that acts as an expandable pocket 16 in which is received the upper edge of cards $B_1$ and $B_2$, the lower edge of these cards being received at the fold between the front and rear panels.

The invention is not limited to the dimensions specified, for the sleeves may be dimensioned to accommodate cards or photos of different dimensions, such as instant photographs produced by Polaroid cameras. Nor is the invention limited to a sleeve for two baseball cards, for the sleeve may be adapted to accommodate only one card or a greater number.

Figure 5:
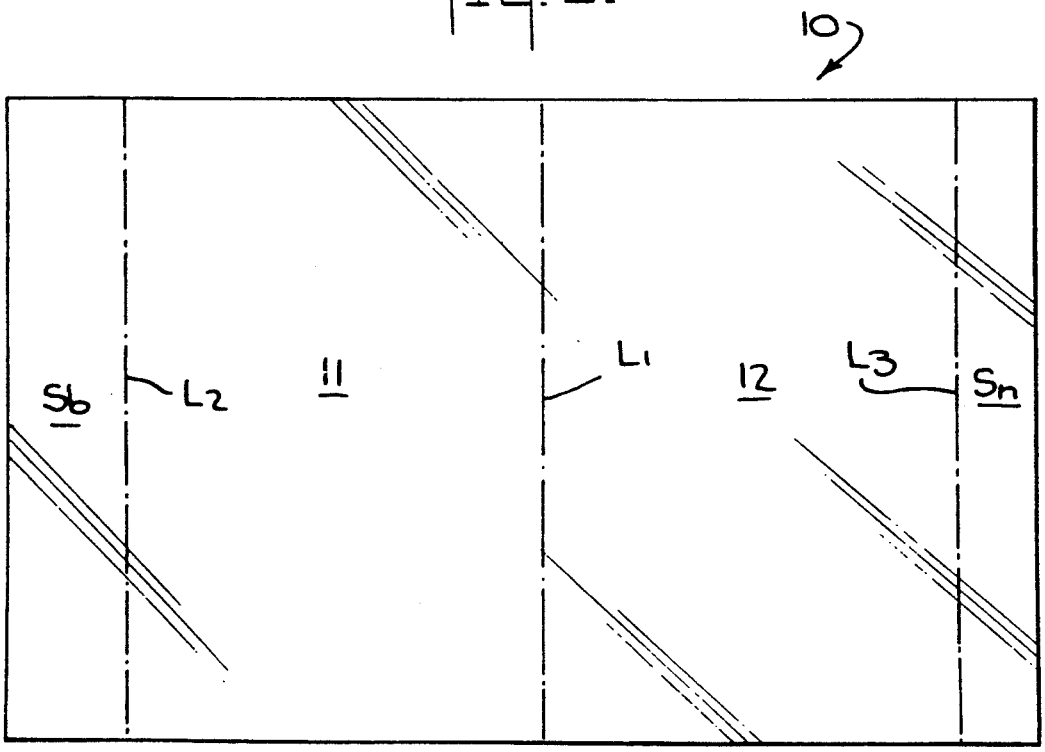
FIG. 5 shows the blank from which the sleeve is formed.
Figure 7:
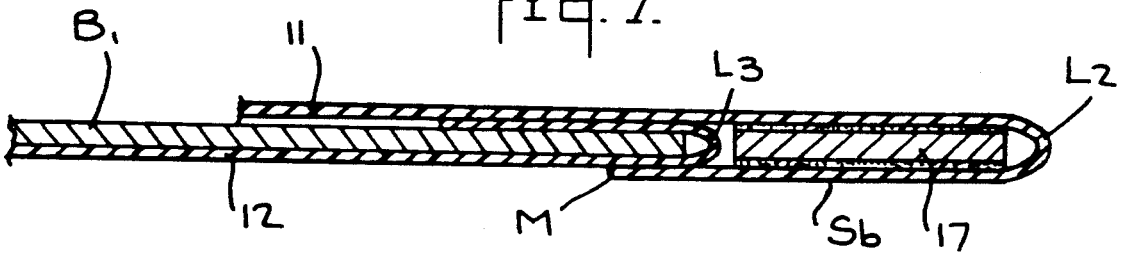
FIG. 7 is an end view of this sleeve.

Sleeve 10 is fabricated from a single rectangular blank of synthetic, plastic transparent film material, as shown in FIG. 5. The preferred material for this purpose is biaxially-oriented polypropylene film of high clarity and archival quality having a thickness of about 2 mils. A sleeve made of this film has an exceptional strength and an almost indefinite life.

The blank has three parallel transverse fold lines $L_1$, $L_2$ and $L_3$. The main fold line $L_1$ divides the blank into front panel 11 and rear panel 12. Transverse fold line $L_2$ is adjacent the edge of front panel 11 to define a broad flap section $S_b$, while transverse fold line $L_3$ is adjacent the end of rear panel $L_3$ to define a narrow flap section $S_n$.

When narrow flap section $S_n$ is folded down on fold line $L_3$ to overlie rear panel 12, it then forms the expandable internal pocket 16 shown in FIG. 1 extending the full length of the sleeve. When front panel 11 is folded on line $L_1$ over rear panel 12 and broad flap section $S_b$ is then folded on transverse line $L_3$ behind rear panel 12 and bonded thereto by a suitable adhesive, this completes the sleeve.

In mass-producing a sleeve in accordance with the invention, use is made of a web of polypropylene film, drawn from a supply reel and fed continuously into a folding machine which first acts to fold over narrow flap section $S_n$ to form internal pocket 16. Applied to the margin of broad flap section $S_b$ is a band of hot melt adhesive. Also fed into the folding machine in parallel to the folded-over narrow section $S_n$ may be a tape or paper strip material 15.

In the folding machine, the front panel 11 is folded on transverse line $L_1$ over rear panel 12, fold line $L_2$ then being adjacent the outer edge of strip 15. Broad section $S_b$ is then folded on line $L_2$ under paper strip 15, so that the wet adhesive band then engages the back of rear panel 12 and is pressed thereagainst to effect bonding. When the fully folded web emerges from the folding machine, it then passes through a sectioning station which cuts the web into individual sleeves of the proper dimensions.

In the embodiment of the sleeve shown in FIGS. 1 to 5, broad flap section $S_b$ is folded over fold line $L_2$ to go behind rear panel 12, the margin of the flap section being adhesively bonded to the rear panel to complete the open-ended sleeve. Hence the cards must be end-loaded into the sleeve.

Figure 6:
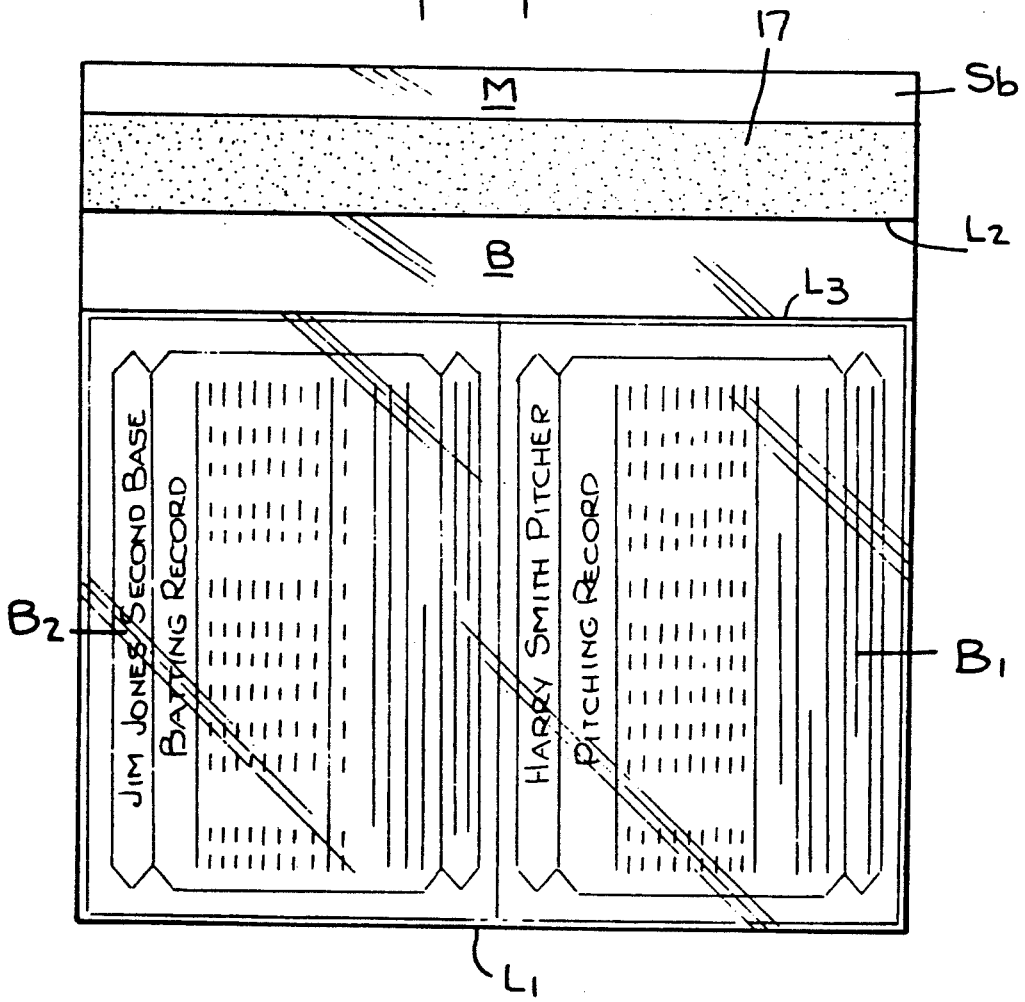
FIG. 6 shows another embodiment of the sleeve in front view.

FIG. 6 shows an embodiment of the sleeve in which the baseball cards $B_1$ and $B_2$ can be loaded into the pocket before the broad flap section $S_b$ is folded over line $L_2$, the broad flap section $S_b$ being shown fully unfolded. Secured to the broad flap section and extending its full length is a double-faced, pressure-sensitive adhesive tape 17 whose width is such as to leave an exposed margin M on flap section $S_b$.

When, therefore, broad flap section $S_b$ is folded over line $L_2$, tape 17 is then adhered to the border B between the pocket fold line $L_3$ and fold line $L_2$ for the broad flap section, the margin M overlying the pocket to complete the sleeve. The two-faced adhesive tape has differential release characteristics so that its underface adheres more strongly to the broad flap section. Hence, to load or unload the cards, the broad flap section must be lifted to provide access to the pocket in which the card is received.

It is not essential to the invention that the sleeves be provided at their borders with punch holes so that the loaded sleeves can be stored in a loose leaf ring binder. In practice, the sleeves may be mounted in staggered or overlapping relation on a backing card so that one can flip through the sleeves to examine the media stored therein. In this arrangement, the border of each sleeve is adhered at an appropriate position, one below the other, to the backing card, the sleeve being folded over the border so that it is hinged to the backing card. And the utility of the invention is not limited to baseball cards, for the sleeves are usable for storing other types of collectibles.

While there have been shown and described preferred embodiments of an album sleeve for baseball cards in accordance with the invention, it will be appreciated that many changes and modifications may be made therein without, however, departing from the essential spirit thereof.

I claim:

1. A sleeve for storing and displaying at least one card, said sleeve being formed from a rectangular blank of synthetic-plastic, transparent film material having three transverse parallel fold lines, the first line dividing the blank into a front panel and a rear panel, the second line defining a broad flap section at the end of the front panel, the third line defining a narrow flap section at the end of the rear panel, the narrow flap section being folded down on the third line to create an expandable internal pocket, the front panel being folded on the first line over the rear panel to overlie the pocket, the broad flap section being folded on the second line to go behind the rear panel to complete the sleeve, the card being loadable into the sleeve so that the upper edge of the card is received in the pocket and the lower edge in the fold between the front and rear panels.

2. A sleeve as set forth in claim 1, in which the card loadable into the sleeve is a printed baseball card whose front side is viewable through the front panel and whose rear side is viewable through the rear panel.

3. A sleeve as set forth in claim 2, in which the sleeve is dimensioned to accommodate two cards in side-by-side relation.

4. A sleeve as set forth in claim 1, in which the blank is made of biaxially-oriented polypropylene.

5. A sleeve as set forth in claim 4, in which the film has a thickness of at least 2 mils.

6. A sleeve as set forth in claim 1, in which the pocket in the rear panel is spaced from the second line to create a border above the pocket.

7. A sleeve as set forth in claim 6, in which the border is provided with punch holes, so that the sleeve may be held in a loose-leaf ring binder.

8. A sleeve as set forth in claim 6, including a tape between the pocket and the second line to reinforce the border.

9. A sleeve as set forth in claim 8, in which the tape is a double-faced, pressure-sensitive adhesive tape.

* * * * *